US008651761B2

(12) United States Patent
Maloney et al.

(10) Patent No.: US 8,651,761 B2
(45) **Date of Patent: *Feb. 18, 2014**

(54) DISPENSING PACKAGE WITH APPLICATOR

(71) Applicant: The Tapemark Company, West St. Paul, MN (US)

(72) Inventors: James M. Maloney, Inver Grove Heights, MN (US); Patrick J. Cody, Shoreview, MN (US)

(73) Assignee: The Tapemark Company, West St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/738,664

(22) Filed: Jan. 10, 2013

(65) Prior Publication Data

US 2013/0121749 A1 May 16, 2013

Related U.S. Application Data

(63) Continuation of application No. 13/346,028, filed on Jan. 9, 2012, now Pat. No. 8,366,337, which is a continuation of application No. 12/209,266, filed on Sep. 12, 2008, now Pat. No. 8,113,730.

(60) Provisional application No. 60/973,121, filed on Sep. 17, 2007.

(51) Int. Cl.
*B43K 5/14* (2006.01)

(52) U.S. Cl.
USPC ..... 401/133; 401/132; 206/229; 206/484.1

(58) Field of Classification Search
USPC ..... 401/132–135; 206/484.1, 229
See application file for complete search history.

(56) References Cited

U.S. PATENT DOCUMENTS 2,530,400 A 11/1950 Leopold
3,315,801 A * 4/1967 Lowry ..... 206/469

(Continued)

FOREIGN PATENT DOCUMENTS

AU 144108 11/1951
CA 1018085 9/1977

(Continued)

OTHER PUBLICATIONS

"European Search Report", from EP Application No. 08164245.6, corresponding to U.S. Appl. No. 12/209,266, dated Dec. 4, 2008, (6 pages).

(Continued)

*Primary Examiner* — Tuan N Nguyen
(74) *Attorney, Agent, or Firm* — Pauly, DeVries Smith & Deffner

(57) ABSTRACT

A package for dispensing a substance is described, where the package includes a stiff sheet that has a score formed on and traversing the first surface. The package also includes a flexible sheet defining a cavity for receiving the substance between the stiff sheet and the flexible sheet. The package also includes an applicator having a porous material pad, where the applicator is attached to the stiff sheet over the score by two hinges. The stiff sheet is configured to be folded about the score to cause the substance to be expelled from the cavity through a metering hole into the porous material pad and the two hinges allow the porous material pad to remain generally flat as the stiff sheet is folded.

14 Claims, 6 Drawing Sheets

(56) References Cited

U.S. PATENT DOCUMENTS

| | | | | | |
|---|---|---|---|---|---|
| 3,369,267 | A | * | 2/1968 | Friedland et al. | 15/104.94 |
| 3,391,047 | A | | 7/1968 | Kopp | |
| 3,453,661 | A | | 7/1969 | Repko | |
| 3,521,805 | A | * | 7/1970 | Ward | 206/539 |
| 3,632,461 | A | | 1/1972 | Gayner et al. | |
| 3,635,376 | A | * | 1/1972 | Hellstrom | 222/107 |
| 3,741,384 | A | * | 6/1973 | Cloud | 206/461 |
| 3,905,479 | A | | 9/1975 | Gerner | |
| 3,924,747 | A | | 12/1975 | Gerner | |
| 3,948,394 | A | | 4/1976 | Hellstrom | |
| 3,986,640 | A | * | 10/1976 | Redmond | 222/92 |
| 4,011,949 | A | | 3/1977 | Braber et al. | |
| 4,084,910 | A | * | 4/1978 | LaRosa | 401/133 |
| 4,125,190 | A | | 11/1978 | Davie et al. | |
| 4,130,245 | A | | 12/1978 | Bryson | |
| 4,140,409 | A | * | 2/1979 | DeVries | 401/132 |
| 4,158,411 | A | | 6/1979 | Hall et al. | |
| 4,173,978 | A | * | 11/1979 | Brown | 604/3 |
| 4,236,652 | A | * | 12/1980 | Beguhn | 222/92 |
| 4,285,468 | A | | 8/1981 | Hyman | |
| 4,371,080 | A | | 2/1983 | Haines | |
| 4,430,013 | A | * | 2/1984 | Kaufman | 401/132 |
| 4,493,574 | A | * | 1/1985 | Redmond et al. | 401/132 |
| 4,557,377 | A | | 12/1985 | Maloney | |
| 4,567,675 | A | | 2/1986 | Rennie | |
| 4,567,986 | A | | 2/1986 | Eastwood | |
| 4,611,715 | A | * | 9/1986 | Redmond | 206/484 |
| 4,643,725 | A | * | 2/1987 | Schlesser et al. | 604/306 |
| 4,648,506 | A | * | 3/1987 | Campbell | 206/216 |
| 4,701,168 | A | * | 10/1987 | Gammons | 604/310 |
| 4,724,982 | A | * | 2/1988 | Redmond | 222/94 |
| 4,819,406 | A | * | 4/1989 | Redmond | 53/51 |
| 4,871,091 | A | * | 10/1989 | Preziosi | 222/92 |
| 4,932,155 | A | | 6/1990 | Friemel et al. | |
| 4,963,045 | A | * | 10/1990 | Willcox | 401/132 |
| 4,982,845 | A | | 1/1991 | Prascak et al. | |
| 5,090,832 | A | * | 2/1992 | Rivera et al. | 401/132 |
| 5,241,150 | A | * | 8/1993 | Garvey et al. | 219/725 |
| 5,316,400 | A | * | 5/1994 | Hoyt et al. | 401/132 |
| 5,368,199 | A | * | 11/1994 | Haas et al. | 222/146.5 |
| 5,368,581 | A | * | 11/1994 | Smith et al. | 604/290 |
| 5,373,966 | A | | 12/1994 | O'Reilly et al. | |
| 5,395,031 | A | * | 3/1995 | Redmond | 222/541.6 |
| 5,494,192 | A | * | 2/1996 | Redmond | 222/107 |
| 5,613,609 | A | | 3/1997 | Hamilton et al. | |
| 6,007,264 | A | * | 12/1999 | Koptis | 401/132 |
| 6,041,930 | A | * | 3/2000 | Cockburn | 206/484 |
| 6,085,942 | A | * | 7/2000 | Redmond | 222/107 |
| 6,536,974 | B2 | * | 3/2003 | Redmond | 401/133 |
| 6,902,335 | B2 | * | 6/2005 | Bergey et al. | 401/132 |
| 6,945,391 | B2 | * | 9/2005 | Moodie | 206/204 |
| 7,121,409 | B1 | * | 10/2006 | Hamilton et al. | 206/484.2 |
| 7,506,762 | B2 | * | 3/2009 | Nelson et al. | 206/484.1 |
| 7,552,823 | B2 | * | 6/2009 | Schuehrer | 206/484 |
| 7,713,666 | B2 | * | 5/2010 | Hayashi et al. | 430/5 |
| 7,718,324 | B2 | * | 5/2010 | Hayashi et al. | 430/5 |
| 7,833,682 | B2 | * | 11/2010 | Hayashi et al. | 430/5 |
| 7,855,036 | B2 | * | 12/2010 | Hayashi et al. | 430/5 |
| 7,906,259 | B2 | * | 3/2011 | Hayashi et al. | 430/5 |
| 8,029,950 | B2 | * | 10/2011 | Hayashi et al. | 430/5 |
| 8,069,985 | B2 | | 12/2011 | Burattini | |
| 8,088,538 | B2 | * | 1/2012 | Hayashi et al. | 430/5 |
| 8,113,730 | B2 | | 2/2012 | Maloney et al. | |
| 8,133,643 | B2 | * | 3/2012 | Hayashi | 430/5 |
| 8,137,872 | B2 | * | 3/2012 | Hayashi | 430/5 |
| 8,225,932 | B2 | | 7/2012 | Burattini | |
| 8,366,337 | B2 | * | 2/2013 | Maloney et al. | 401/133 |
| 2005/0178086 | A1 | * | 8/2005 | Bakken | 53/412 |
| 2006/0251973 | A1 | * | 11/2006 | Takaki et al. | 430/5 |
| 2006/0283727 | A1 | * | 12/2006 | Nelson et al. | 206/219 |
| 2009/0074502 | A1 | * | 3/2009 | Maloney et al. | 401/133 |
| 2011/0104595 | A1 | * | 5/2011 | Hayashi et al. | 430/5 |
| 2011/0200920 | A1 | * | 8/2011 | Hayashi | 430/5 |
| 2012/0114411 | A1 | | 5/2012 | Maloney et al. | |

FOREIGN PATENT DOCUMENTS

| | | |
|---|---|---|
| DE | 2751078 | 5/1979 |
| DE | 4203430 | 8/1993 |
| EP | 0081791 | 6/1983 |
| EP | 0597446 | 5/1994 |
| EP | 1227047 | 7/2002 |
| GB | 1572603 | 7/1980 |
| WO | WO-9220595 | 11/1992 |
| WO | WO-0117875 | 3/2001 |
| WO | WO-2008038074 | 4/2008 |
| WO | WO-2009040629 | 4/2009 |

OTHER PUBLICATIONS

"File History", for abandoned U.S. Appl. No. 12/408,172, filed Mar. 20, 2009, entitled "Dispensing Package", (189 pages).

"File History", for issued patent 7,506,762, co-pending U.S. Appl. No. 11/380,533, "Dispensing Package" (393 pages).

"File History", for issued U.S. Patent 8,113,730, U.S. Appl. No. 12/209,266, filed Sep. 12, 2008, entitled "Dispensing Package With Applicator" (81 pages).

"File History", for issued U.S. Patent 8,366,337, U.S. Appl. No. 13/346,028, filed Jan. 9, 2012, entitled "Dispensing Package With Applicator" (106 pages).

"SurgiSeal™ Application" Professional Use Reference, Adhezion Biomedical, Copyright date 2010, though Applicants believe that the SurgiSeal Application product existed as early as Oct. 2007.

* cited by examiner

DISPENSING PACKAGE WITH APPLICATOR

This application is a continuation of U.S. patent application Ser. No. 13/346,028, issued on Feb. 5, 2013 as U.S. Pat. No. 8,366,337, which is a continuation of U.S. Pat. No. 8,113,730, issued Feb. 14, 2012, which claims the benefit of U.S. Provisional Application No. 60/973,121, filed Sep. 17, 2007, the content of which is herein incorporated by reference.

BACKGROUND

This application relates to packages for dispensing a fluid, gel, paste or other substances that can move through an opening. More specifically, this application related to dispensing packages that can be opened easily, often with a single hand.

U.S. patent application 2006/0283727 describes a dispensing package that includes a plastic backing for maintaining a flat orientation of the package. FIGS. 4G and 5C from U.S. Published patent application 2006/0283727 show an embodiment of a package having a foam applicator. A score into the plastic backing is positioned in the middle of the package. When a user bends the package, the plastic backing breaks along the score. As a result, the contents of the package are released through a metering hole. In this design, the applicator is adhered along its entire side to the plastic backing layer, so that as the package is opened, the sides of the foam applicator are folded back from the middle portion of the applicator. Only a portion of the applicator is then usable at any one time for applying the contents of the package. Although the applicator has a relatively large surface area prior to the package being opened, the effective surface area of the applicator is dramatically reduced as the package is folded to the open position. Improved arrangements for dispensing packages are desired.

SUMMARY

In one embodiment of the invention, a package for dispensing a substance includes a stiff sheet having a first major surface and a second opposite major surface, the stiff sheet including a score formed on and traversing the first surface. The score defines a first region on one side of the score and a second region on the opposite side of the score. The package further includes a flexible layer bonded to the second surface of the stiff sheet, the flexible layer configured to provide support to the stiff sheet after it has been bent around the score, where the flexible layer defines a metering hole aligned with the score. The package also includes a flexible sheet bonded to the flexible layer and the second surface of the stiff sheet around a perimeter and defining a cavity for receiving a substance between the flexible layer and the flexible sheet. An applicator is also included in the package, where the applicator has a porous material pad and is attached to the first surface of the stiff sheet over the score by two hinges, each hinge including a flexible material bonded in part to the first surface of the stiff sheet and bonded in part to the applicator.

In another embodiment, the package further includes a barrier layer that is part of the applicator. The barrier layer is adhered to the porous material pad, and the hinges are bonded to the barrier layer.

In one further embodiment, the stiff sheet of the package also includes a stiff sheet metering hole defined on the second surface of the stiff sheet in alignment with the score, and aligned with the metering hole of the flexible layer.

In some of the embodiments, the stiff sheet is configured to be folded about the score to cause the substance to be expelled from the cavity through the metering hole of the flexible layer into the porous material pad and the two hinges allowing the porous material pad to remain generally flat as the stiff sheet is folded.

This Summary is provided to introduce a selection of concepts in a simplified form that are further described in the Detailed Description. This Summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The inventors have devised a dispensing package arrangement with which it is easy to open and dispense a substance with a single hand on to an applicator pad, and to allow a much greater surface area of the applicator to be applied to a target surface than has been possible in the past. The applicator of the present invention stays nearly perpendicular to the opened package. By keeping the applicator perpendicular, there is no loss in effective surface area in contact with the target surface and the applicator will be more effective in dispensing the fluid. Hinges attach the applicator to the package to accomplish this advantage, in one embodiment. In a specific embodiment, the applicator includes both an absorbent or porous material and a barrier layer, where the hinges attach to the barrier layer.

Figure 1:
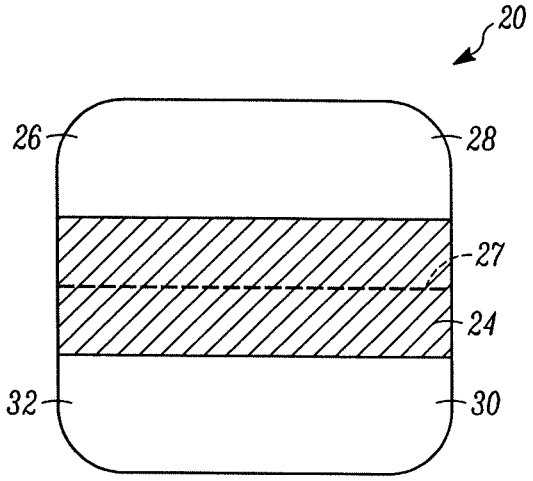
FIG. 1 is a bottom view of a dispensing packing having an applicator and constructed according to the principles of the present invention.

An embodiment of a package for dispensing a fluid substance is shown in the Figures. FIG. 1 is a bottom view of a package 20. Package 20 includes a stiff sheet 26. An applicator 24 is present at a middle area of the package 20. Applicator 24 is typically constructed from an absorbent or porous material and a barrier layer, which will be further described herein with respect to other Figures. The absorbent or porous material is capable of conforming to a surface to which the substance will be applied. The applicator 24 can be foam (of any cell variation), cotton, a non-woven material, or any other material that absorbs a fluid, gel or paste and allows the fluid to be spread onto a target surface. Underneath the applicator 24, the stiff sheet includes a score 27, where score 27 generally traverses and is through the middle of the stiff sheet 26 and defines a first region 28 on one side of score 27 and a second region 30 on an opposite side of score 27. The score may be a continuous groove, or an intermittent groove, in the stiff sheet 26. The applicator 24 is positioned generally over score 27 on stiff sheet 26. The applicator 24 is positioned so that the score 27 is at the approximate center of the applicator 24. FIG. 1 shows the location of score 27 relative to the stiff sheet 26 and the applicator 24, although the score 27 is not actually visible from this view due to being covered by the applicator 24.

Figure 2:
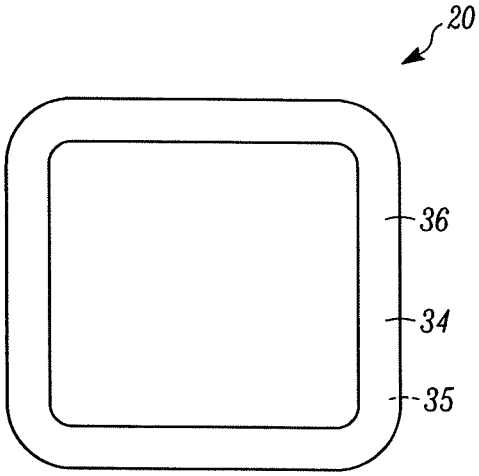
FIG. 2 is a top view of the dispensing package of FIG. 1.

FIG. 2 illustrates the second, back, side 34 of the package 20. A flexible sheet 36 is bonded to second side 34 around a perimeter 35. Flexible sheet 36 may be bonded by a variety of mechanisms, including heat sealing, ultrasonic welding, adhesive, or other means. Between flexible sheet 36 and stiff sheet 26, a cavity is defined for receiving and containing a substance to be dispensed. The substance to be dispensed is any substance that is capable of flowing through an opening, and for which an applicator for spreading the substance is desirable, including everything from very low viscosity liquids such as water or alcohol to very high viscosity substances such as gels, pastes, and creams.

Figure 3:
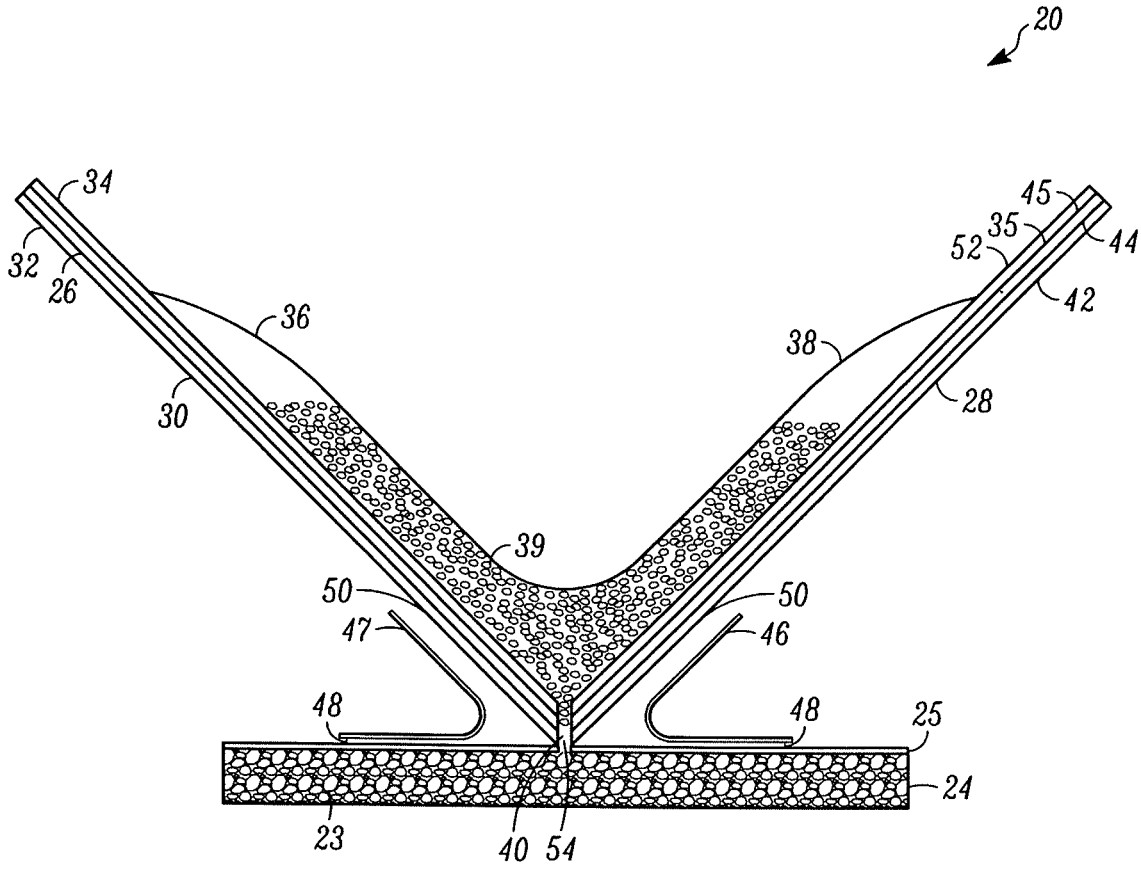
FIG. 3 is a cross sectional view of the dispensing package of FIG. 1 in a dispensing position.

FIG. 3 is a partially exploded cross-sectional view of the package 20, where the cross-section is taken along the middle of the package. The first side 32 includes the applicator 24 and a second side 34 includes the flexible sheet 36. The cavity 38 for holding the substance 39 to be dispensed is defined between the flexible sheet 36 and the stiff sheet 26. The package 20 is illustrated in a dispensing position, where the stiff sheet 26 has been bent about score 27 so that stiff sheet 26 fractures along the score 27 to provide an opening 40 from first side 32 to second side 34.

Figure 4:
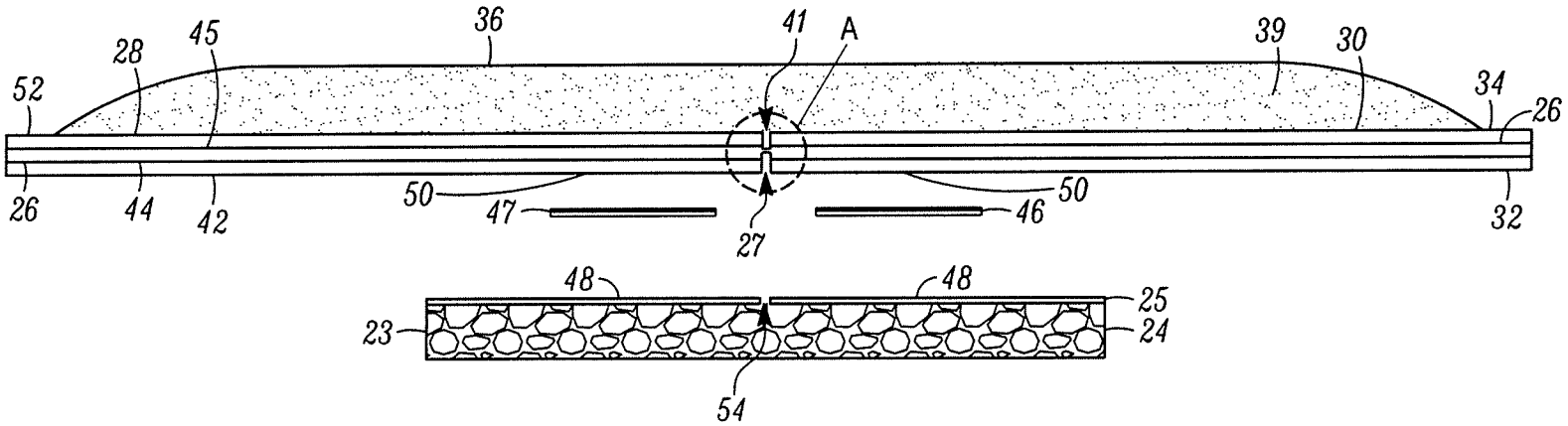
FIG. 4 is an exploded cross-sectional view depicting the layers of material of the dispensing package of FIG. 1.
Figure 5:
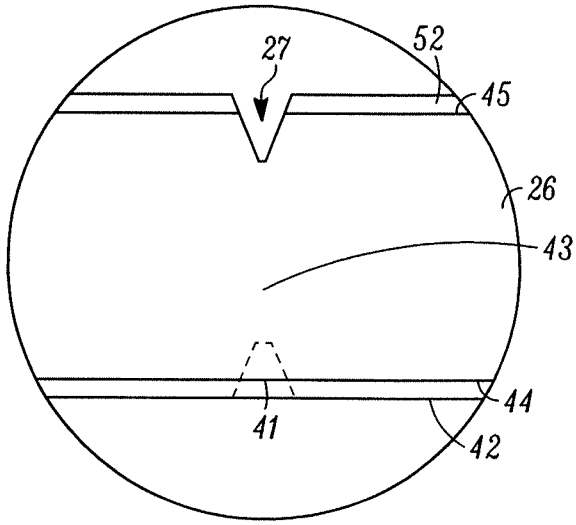
FIG. 5 is a side view of a portion of the stiff sheet where a score and a metering opening are located.

FIG. 4 is a partially exploded cross-sectional view similar to FIG. 3, except that the package 20 is shown in an un-flexed, non-dispensing position. Now referring to FIGS. 3 and 4, in order to provide the opening 40 upon breaking, the package includes the score 27 on a first side 32 and a metering hole 41 on the second side 34. Area A on FIG. 4 is shown in an enlarged view in FIG. 5. FIG. 5 is a side view of the stiff sheet. The metering hole 41 is a hole in the stiff sheet 26 that extends only part way into the stiff sheet. The metering hole 41 is in the center of the stiff sheet, and so is shown in phantom lines in the side view of FIG. 5. The metering hole 41 is aligned with the score 27 so that the opening 40 (shown in FIG. 3) for dispensing the substance is created at the location of the metering hole 41 when the package is bent. The portion 43 of the stiff sheet between the score 27 and the metering hole 41 serves to seal the contents of the package. The score 27 and the metering hole 41 each extend into the stiff sheet 26 by about 8-10% of the thickness of the stiff sheet 26. Where the stiff sheet is about 18 mils (0.5 mm), the score 27 and metering hole 41 each extend about 2 mils (0.05 mm) into the stiff sheet.

In some embodiments, as depicted in FIGS. 3-5, a label 42 may be applied to a first surface 44 of stiff sheet 26 in order to provide instructions, identification, marketing, or regulatory messages, for example. A layer of adhesive, not shown, may be used to adhere label 42 to stiff sheet 26.

In some embodiments, a second flexible layer 52 is bonded to a second side 45 of stiff sheet 26. Flexible layer 52 serves to provide an additional layer of protection of the contents of the package from the outside environment. The metering hole 41 is made through the flexible layer 52 as well as penetrating into the second side 45 of stiff sheet and thereby forms a dispensing opening 40 (shown in FIG. 3) when the package is bent for dispensing. Opening 40 extends through flexible layer 52 and partly through stiff sheet 26 when stiff sheet is not bent.

Figure 6:
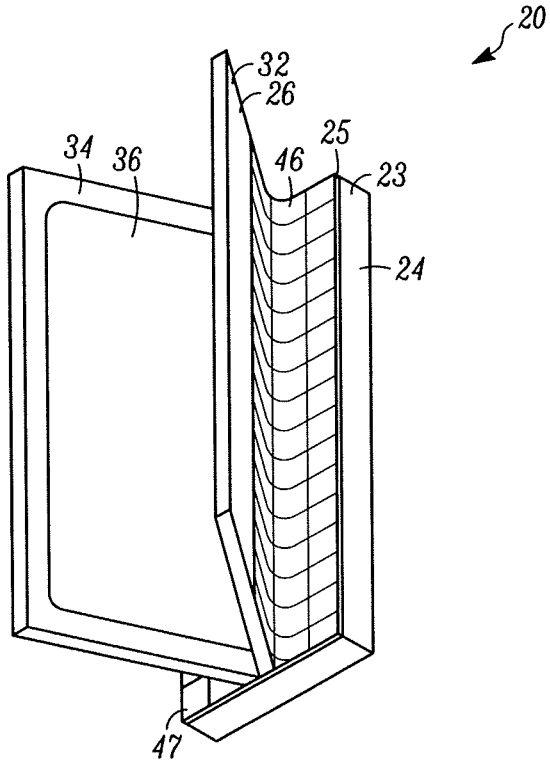
FIG. 6 is an alternative perspective view of the dispensing package of FIG. 1.

As discussed above, package 20 includes an applicator 24 constructed from an absorbent or porous material. Applicator 24 is configured to remain relatively flat even as stiff sheet 26 is bent or folded, as illustrated in FIGS. 3 and 6. To accomplish this, applicator 24 is attached to stiff sheet 26 by two hinges 46, 47. Each hinge 46, 47 is formed from a flexible material that allows a variable distance to be defined between an attachment region 48 on applicator 24 and an attachment region 50 on stiff sheet 26. In FIG. 3, the hinges 46, 47 are shown spaced away from the attachment region 48 and the attachment region 50 for ease of illustration of those regions. However, the hinges will be contacting the attachment regions 48, 59 when the package is actually assembled. When stiff sheet 26 is in a generally planar condition, a relatively minimal distance is defined between stiff sheet 26 and applicator 24, as can be visualized from the exploded view in FIG. 4.

When stiff sheet 26 is in a bent or folded condition, a relatively greater distance is defined between stiff sheet 26 and applicator 24, as shown in FIGS. 3 and 6. The hinges 46, 47 are configured to provide an attachment of applicator 24 to stiff sheet 26 despite such a change in distance. Each hinge is generally constructed from a piece of flexible material that is folded to have a nearly planar shape when the stiff sheet 26 is in a planar condition, as shown in FIG. 4, and to have a generally "U" or "V" shape in cross-section when stiff sheet 26 is in a bent condition, as seen in FIG. 3. An attachment is provided from an outer surface of one leg of the "U" or "V" shaped flexible material to the applicator 24, and an attachment is provided from an outer surface of one leg of the "U" or "V" shaped flexible material to the applicator 24. In one embodiment, the attachment is formed by the application of adhesive. Where the hinges are attached with adhesive, the adhesive coating of the hinges is facing the stiff sheet on one side and the applicator on the other side, where the hinges are shown folded in FIG. 4. However, other methods of forming an attachment are also usable. For example, ultrasonic welding could be employed, depending on the compatibility with the materials selected.

In one embodiment, there is one hinge 46 provided on one side of score 27 and another hinge 46 provided on the opposite side of score 27. Each hinge 46 generally runs parallel to score 27 and extends across the width of stiff sheet 26. With two such hinges 46, 47 on either side of the score 27, when the package 20 is opened, it will allow the applicator 24 to remain nearly flat without bending, due to the effect of the hinge. As the stiff sheet 26 is bent further, the hinge 46 "unfolds" and extends, allowing for a greater distance between applicator 24 and first side 32 of stiff sheet 26 and thereby allowing applicator 24 to remain generally flat. When the stiff sheet 26 is bent completely around score 27, such that both second sides 34 of stiff sheet 26 are brought together, the stiff sheet 26 will form a handle that the user can grasp and use to manipulate the applicator 24 and apply the fluid contents to a target surface.

The hinge 46 can be polypropylene, or foil, or paper, or any such material that allows the hinge principle to work. For example, the hinge 46 can be constructed from 2-3 mil (0.05-0.08 mm) polypropylene label stock. Such label stock is convenient for use in forming the hinge because it has adhesive pre-applied. Likewise, 2-3 mils (0.05-0.08 mm) polyethylene and 1 mils (0.03 mm) polyester are also suitable hinge materials.

Figure 7:
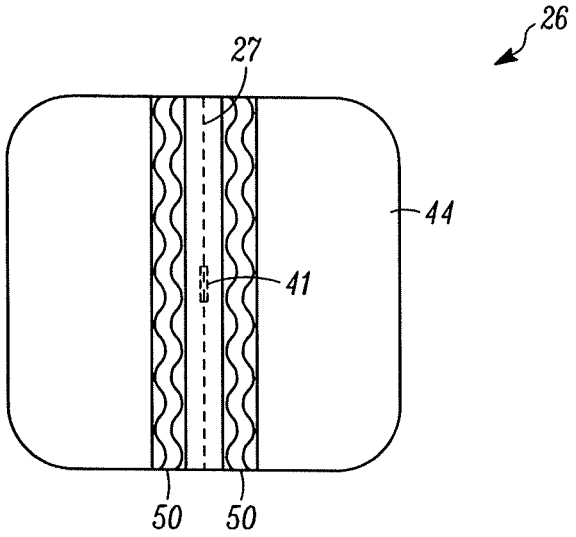
FIG. 7 is a view of the first side of a stiff sheet of the dispensing package of FIG. 1, which is the side to which the applicator will be attached.

FIG. 7 shows a view of a first side 44 of stiff sheet 26 where hinge attachment regions 50 indicate the approximate locations and areas of where the hinges 46, 47 attach to the stiff sheet, or where the hinges attach to the label 52 if one is present on the stiff sheet. FIG. 7 also illustrates the score 27, which is present on the first side of the stiff sheet in the illustrated embodiment. FIG. 7 also illustrates in broken lines the location of the metering hole 41 which is present on the opposite, second side of the stiff sheet. The metering hole 41 itself would not be visible from the view of the first side of the stiff sheet of FIG. 7, so the metering hole location is shown in broken lines. The hinge attachment zones 50 constitute less than the entire surface area of applicator 24, and each hinge attachment zone 50 runs generally parallel to and offset from score 27.

Figure 8:
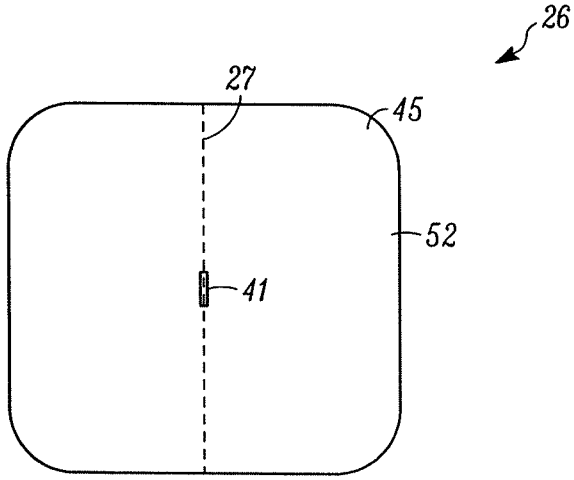
FIG. 8 is a view of the second side of the stiff sheet of the dispensing package of FIG. 1.

FIG. 8 shows a view of the second side 45 of the stiff sheet 26. The flexible layer 52 can also be present on the second side 45 of the stiff sheet. The metering hole 41 is illustrated, which extends partly through the stiff sheet 26. If the flexible layer 52 is present, then the metering hole 41 extends through the entire thickness of the flexible sheet 36.

Figure 9:
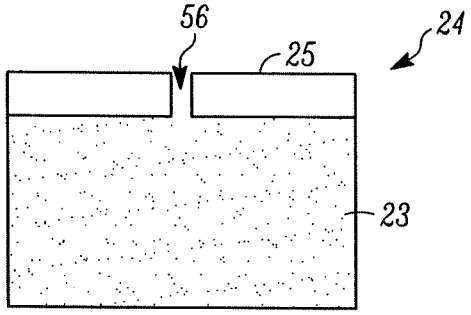
FIG. 9 is a side view of an absorbent material and barrier layer.

FIG. 9 is a side view of the applicator 24 including an absorbent or porous material 23 and a barrier layer 25. The absorbent or porous material 23 can be foam (of any cell variation), cotton, a non-woven material, or any other material that absorbs a fluid, gel or paste and allows the fluid to be spread onto a target surface. The barrier layer 25 is attached to a first side 54 of the material 23 and the barrier layer 25 defines a barrier layer score 56 which is made of one or more slits or cuts along the center of the first side 54 so that the barrier layer score 56 will be aligned with the score 27 of the stiff sheet when the package is assembled. In one embodiment, the slits in the barrier layer are evenly spaced.

The barrier layer 25 causes all of the substance to be dispensed to be directed through the slits of the barrier layer score 56 in to the material 23. As a result, the effectiveness and efficiency of the applicator pad are improved. In addition, the presence of the barrier layer improves the adhesion of the pressure-sensitive adhesive (PSA) of the hinges 46, 47 and prevents the PSA from migrating into the substance to be dispensed. The barrier layer further prevents the substance being dispensed from coming into contact with the PSA and adversely affecting the performance of the PSA. The porous or absorbent material adhered to the barrier layer can be purchased as an assembly.

For thinner liquids, a foam material may be more desirable than a non-woven material. One example of nonwoven material and barrier material that may be used is needle-punched polypropylene and Delnet facing material available from DelStar Technologies, Inc. of Middletown, Del. One example of a foam material that may be used as an absorbent material 23 is hydrophilic polyurethane foam available from Rynel of Wiscasset, Md. An example of another barrier layer is a breathable, cast, matte polyurethane film having a thickness of about 30 micrometers available from InteliCoat of the United Kingdom.

Typical thickness for stiff sheet 26 ranges from 5 to 20 mils (0.1 to 0.5 mm). Stiff sheet 26 is, in one embodiment, formed from polystyrene and approximately 16-18 mils (0.4-0.5 mm) thick. Stiff means that a component is firm, generally rigid, does not easily bend or give way, and can be flexed only with difficulty. Stiff implies that there may be some elasticity associated with the component and does not preclude that when a force is applied it may bend to a slight degree without damage or deformation. Stiff may further mean that a component has a first elastic limit and a shear modulus that are sufficient to maintain the component in a substantially flat configuration.

Flexible sheets 36 and 52 can each be one layer or can be formed from multiple layers. Flexible means capable of being readily bent and pliant. In one embodiment, flexible sheet 36 and flexible sheet 52 are each a foil. Various other combinations of materials are also usable for either or both of the flexible sheets 36, 52. One possible combination of materials that can be used as a flexible sheet is a layer of 48 gauge (12 micrometer) sheet material, an adhesive layer, and a layer of 2.5 mil (0.06 mm) LLDPE (linear low density polyethylene). The sheet material may be either white or clear. Another possible combination is a layer of 48 gauge (12 micrometer) metalized PET (METPET) sheet material, an adhesive layer, and a layer of LLDPE sheet material. Yet another possible combination of materials is a layer of foil 48 gauge (12 micrometer) PET sheet material, 9-pound (4 kg) co-extrusion sheet material, 0.000285 inch (0.007 mm) thick foil, 12-pound (5 kg) coextrusion sheet material, and 1.5 mil (0.04 mm) LLDPE sheet material. Another possible combination of materials is a layer of silver foil 48 gauge (12 micrometer) PET sheet material, adhesive, 0.00035 inch (0.009 mm) thick foil, adhesive, and 2 mil (0.05 mm) LLDPE sheet material.

FIGS. 3 and 6 show the package in a partially bent configuration. In use, package 20 is configured so that a user can use his or her fingers to bend stiff sheet 26 around score 27. In some cases, a user may use both hands to bend stiff sheet 26 around score 27, and in other cases, may bend stiff sheet around score 27 by pushing stiff sheet 26 against an object. As stiff sheet 26 is bent, it fractures in the root of score 27, causing the depth of score 27 from first surface 32 to increase. As stiff sheet 26 continues to be bent, score 27 expands to the point that an opening is formed in registration with metering hole 41 in the stiff sheet 26 and in the flexible sheet 52, thereby creating opening 40, through which the contents in cavity 38 flow. Flexible layer 52 is generally configured to keep stiff sheet 26 from completely separating at score 27, while still providing a metering hole 41 and then opening 40 for material to flow through. FIG. 6 shows an alternative view of package 20 in a partly bent configuration, and FIG. 3 shows a cross-sectional view of package 20 in a partly bent configuration. As the contents flow from score 27, they pass through the barrier layer score 54 into the absorbent or porous material 23 and are absorbed into applicator 24. By continuing to bend stiff sheet 26, the second surfaces 34 of stiff sheet tend to press against flexible sheet 36, thereby compressing the contents of cavity 38 and expelling the contents through opening 40. These contents continue to fill applicator 24, and the user can apply applicator 24 to a target surface in order to apply the contents to the target surface. By virtue of the fact that applicator 24 remains generally flat regardless of the degree to which stiff sheet 26 is bent, a relatively large surface area is available on applicator 24 for applying the contents to the target surface. This arrangement improves the efficiency of transfer to the target surface, allowing more material to be applied faster, and also allows material to be applied more evenly and uniformly.

In FIGS. 3-4, the hinge 46 is parallel to the score 27, and there are two hinges 46, one on either side of the score. The design of the hinge 46 can be varied in few other ways, still meeting the primary need of flat applicator 24. The hinge 46 can be designed such that, it will still have the hinge feature as specified above, however, with a shape of oval or circular or any such custom shaped variation, surrounding the opening 40 (or nearly surrounding, if the custom shape has gaps). This will allow the use of a circular or other custom shaped applicator foam.

A variety of sizes of package 20 and applicator 24 are usable. In one example embodiment, package 20 (or more specifically, stiff sheet 26) is about 1.413 inches (35.890 mm) wide by 1.75 inches (44.45 mm) long, for a total of 2.5 $in^2$(1595.3 $mm^2$), and the corresponding applicator 24 is 0.413 inches (10.490 mm) wide by 0.75 inches (19.05 mm) long, for a total of 1 $in^2$(199.838 $mm^2$). In another example embodiment, stiff sheet 26 is 3.14 inches (79.76 mm) wide by 4 inches (101.6 mm) long, for a total of 12.6 $in^2$(8103.2 $mm^2$), and applicator 24 is 3.14 inches (79.76 mm) wide by 1.5 inches (38.1 mm) long, for a total of 4.7 $in^2$(3038.7 $mm^2$). For example, for rectangular configurations, typical lengths and/or width dimensions range from 0.5 inches (12.7 mm) to 12 inches (304.8 mm), more typically from 1 inch (25.4 mm) to 5 inches (127 mm). The surface area of the package ranges from 1 $in^2$ (645 $mm^2$) to 25 $in^2$ (16129 $mm^2$), more typically from 2 $in^2$ (1290 $mm^2$) to 15 $in^2$ (9677 $mm^2$). Other sizes are usable.

Various modifications and alterations of this invention will be apparent to those skilled in the art without departing from the scope and spirit of this invention, and it should be understood that this invention is not limited to the illustrative embodiments set forth herein. All U.S. patents, patent application publications, and other patent and non-patent documents referred to herein are incorporated by reference, to the extent they are not inconsistent with the foregoing disclosure.

What is claimed is:

1. A package for dispensing a substance, the package comprising:

(i) a stiff sheet having a first major surface and a second opposite major surface, the stiff sheet comprising a score formed on and traversing the first surface, the score defining a first region on one side of the score and a second region on the opposite side of the score;

(ii) a flexible sheet bonded to the second surface of the stiff sheet around a perimeter and defining a cavity for receiving a substance between the stiff sheet and the flexible sheet; and (iii) an applicator having an absorbent material pad, wherein the applicator is attached to the first surface of the stiff sheet over the score by two hinges, each hinge comprising a flexible material bonded in part to the first surface of the stiff sheet and bonded in part to the applicator.

2. The package of claim 1 wherein the absorbent material pad is capable of spreading a fluid onto a target surface.

3. The package of claim 2 wherein the absorbent material pad is capable of absorbing excess fluid, a gel, or a paste from the target surface.

4. The package of claim 1 wherein the absorbent material pad is capable of absorbing an excess of a fluid, a gel, or a paste from a target surface.

5. The package of claim 1 wherein the absorbent material pad comprises a nonwoven material.

6. The package of claim 1 wherein the absorbent material pad comprises a foam.

7. The package of claim 6 wherein the foam comprises a hydrophilic polyurethane.

8. The package of claim 1 wherein the applicator further comprises a barrier layer adhered to the absorbent material pad, wherein the hinges are bonded to the barrier layer.

9. The package of claim 8 wherein the barrier layer is breathable.

10. The package of claim 8 wherein the barrier layer comprises a cut in alignment with the score of the stiff sheet.

11. The package of claim 10 wherein the barrier layer comprises a series of cuts in alignment with the score of the stiff sheet.

12. The package of claim 1 wherein the first and second regions of the stiff sheet are approximately equal in area.

13. The package of claim 1 having a label adhered to the first surface of the stiff sheet.

14. The package of claim 1 wherein the applicator pad is approximately centered on the score.

* * * * *